US007335463B2

(12) United States Patent
Rosa et al.

(10) Patent No.: US 7,335,463 B2
(45) Date of Patent: Feb. 26, 2008

(54) ELECTROPLATED THREE DIMENSIONAL INK JET MANIFOLD AND NOZZLE STRUCTURES USING SUCCESSIVE LITHOGRAPHY AND ELECTROPLATED SACRIFICIAL LAYERS

(75) Inventors: Michel A Rosa, Queensland (AU); Eric Peeters, Freemont, CA (US)

(73) Assignee: Palo Alto Research Center, Inc., Palo Alto, CA (US)

( * ) Notice: Subject to any disclaimer, the term of this patent is extended or adjusted under 35 U.S.C. 154(b) by 664 days.

(21) Appl. No.: 11/012,697

(22) Filed: Dec. 16, 2004

(65) Prior Publication Data

US 2006/0134561 A1 Jun. 22, 2006

(51) Int. Cl.
*B41J 2/16* (2006.01)

(52) U.S. Cl. ..... 430/320; 430/324; 216/27; 205/122

(58) Field of Classification Search ..... None
See application file for complete search history.

(56) References Cited

U.S. PATENT DOCUMENTS 4,438,191 A * 3/1984 Cloutier et al. ..... 430/324
6,475,369 B1 11/2002 Cohen
2003/0127336 A1 7/2003 Cohen et al.
2003/0183008 A1 10/2003 Bang et al.
2003/0221968 A1 12/2003 Cohen et al.
2003/0222738 A1 12/2003 Brown et al.
2003/0234179 A1 12/2003 Bang
2004/0004001 A1 1/2004 Cohen et al.
2004/0004002 A1 1/2004 Thompson et al.
2004/0007468 A1 1/2004 Cohen et al.
2004/0007469 A1 1/2004 Cohen et al.
2004/0007470 A1 1/2004 Smalley
2004/0020782 A1 2/2004 Cohen et al.
2004/0140862 A1 7/2004 Brown et al.

FOREIGN PATENT DOCUMENTS

JP 11-207974 A * 8/1999
WO WO 01/03934 A1 * 1/2001

* cited by examiner

*Primary Examiner*—John A. McPherson
(74) *Attorney, Agent, or Firm*—Oliff & Berridge PLC

(57) ABSTRACT

Mechanical and/or structural devices are formed using electroplating techniques in conjunction with sacrificial materials that can also be formed using electroplated techniques. This can produce devices that are attached at only selected points to a substrate and/or structures having enclosed cavities on or above a working substrate. A particularly relevant use of such structure forming techniques is in the fabrication of an ink jet manifold and nozzle structure for use in an ink jet print head, particularly a MEMS-based ink jet print head.

19 Claims, 11 Drawing Sheets

FIG. 16
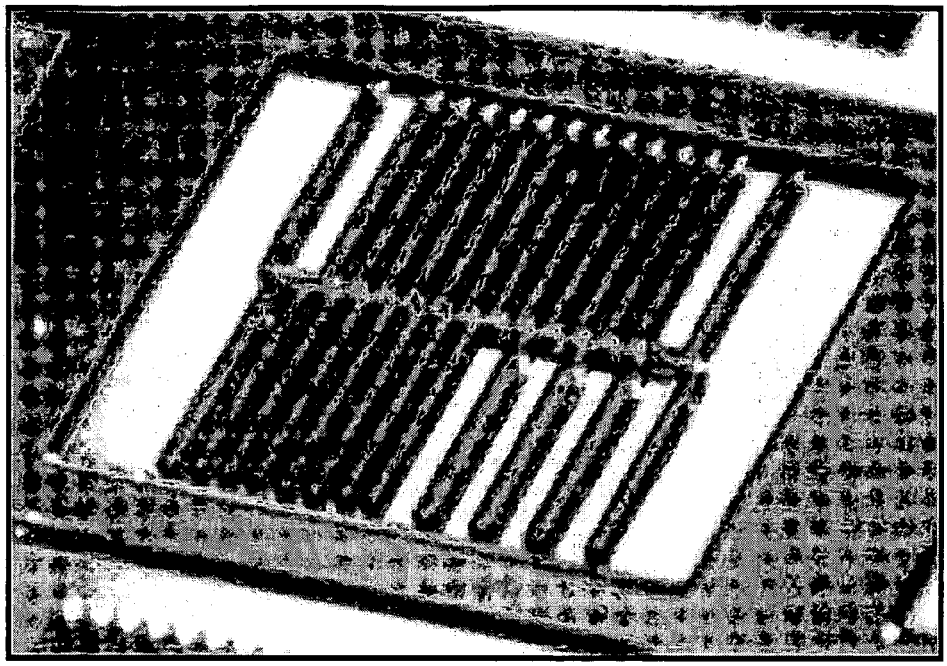
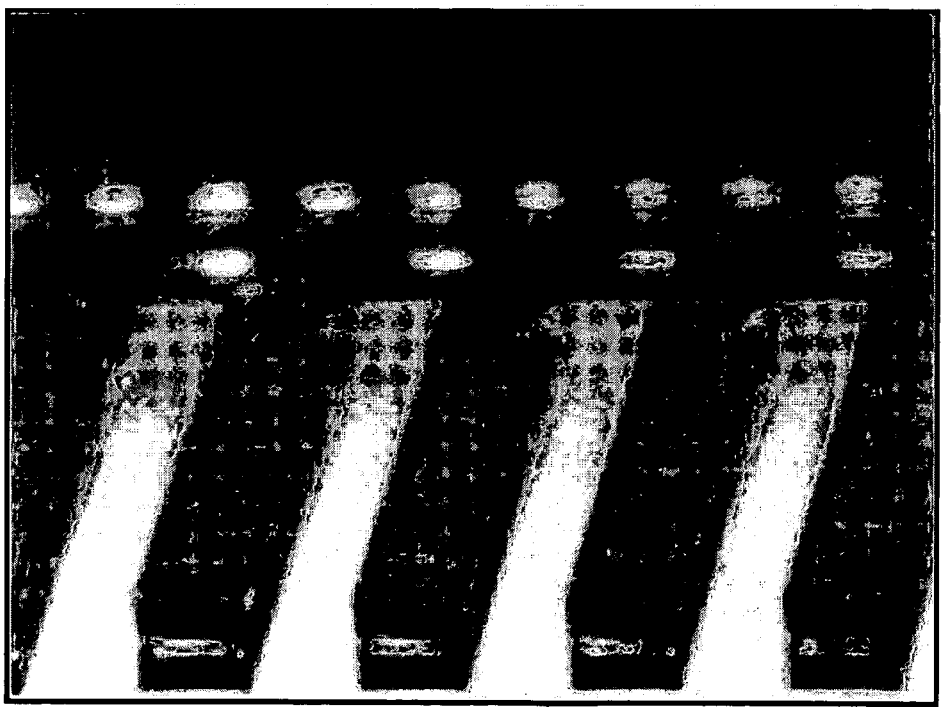
FIG. 17

FIG. 23
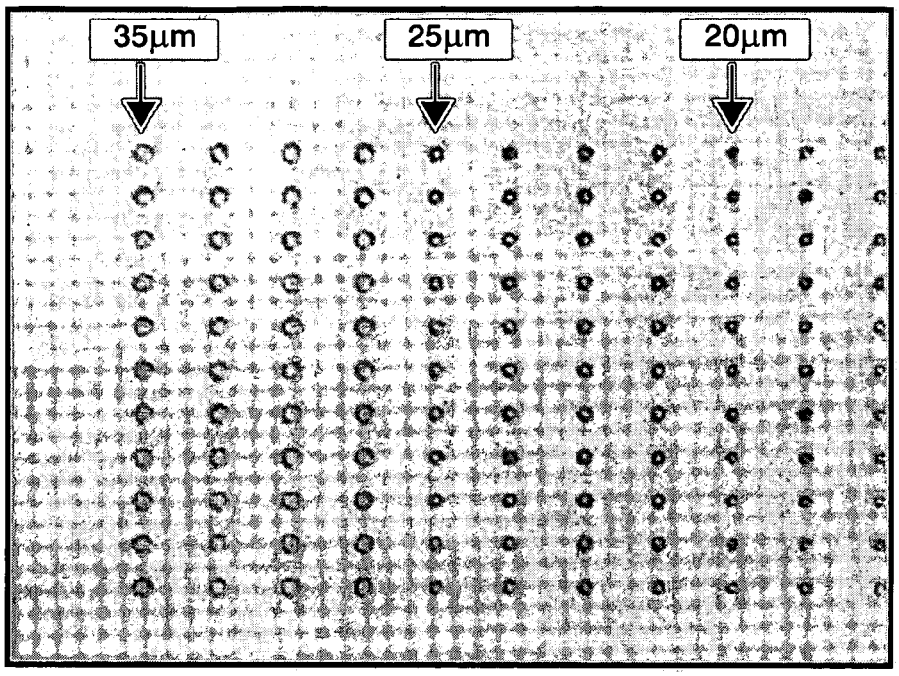
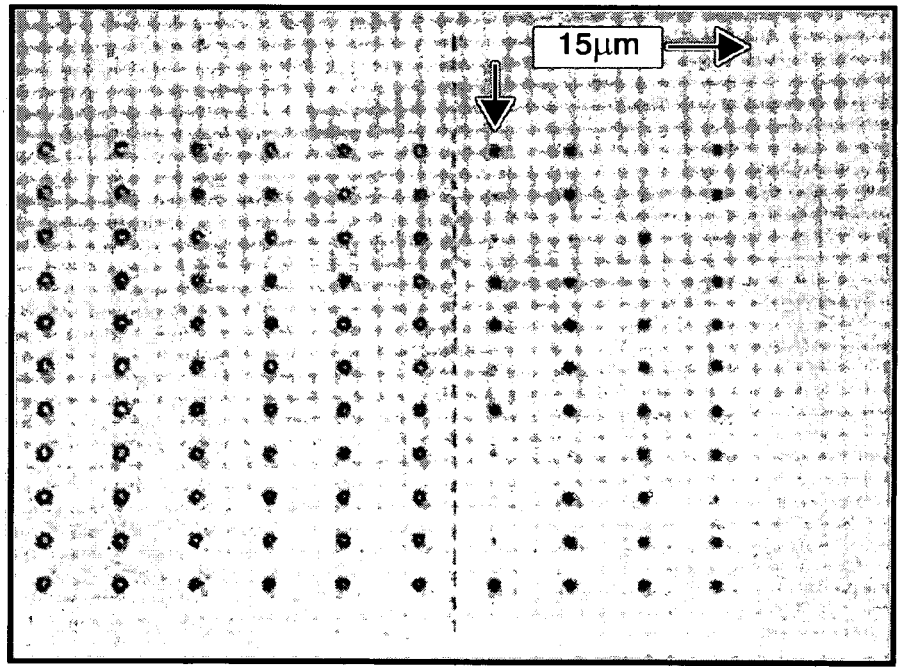
FIG. 24

ELECTROPLATED THREE DIMENSIONAL INK JET MANIFOLD AND NOZZLE STRUCTURES USING SUCCESSIVE LITHOGRAPHY AND ELECTROPLATED SACRIFICIAL LAYERS

BACKGROUND

Three dimensional structures serving as ink jet manifold and nozzles are formed in successive layers by photolithography and electrodeposition to surround one or more cavities. This is particularly suited for the manufacture of thick manifold and/or nozzle structures in MEMS-based ink jet print heads that create fluid channels or cavities through which ink or other fluids can flow.

Currently, electroplated structures fabricated for MEMS-type applications are typically made using a single layer of structural material that is micro machined. A few multiple layered structures have been fabricated using alternate deposition of structural and sacrificial layers. Examples of these include: U.S. Pat. No. 6,475,369 to Cohen, U.S. Patent Application Publication No. US2004/0004001A1 to Cohen et al., U.S. Patent Application Publication No. US2003/0234179A1 to Bang, U.S. Patent Application Publication No. US2003/0221968A1 to Cohen et al., U.S. Patent Application Publication No. US2004/004002A1 to Thompson et al., U.S. Patent Application Publication No. US2004/007468A1 to Cohen et al., U.S. Patent Application Publication No. US2004/0007469A1 to Zhang et al., U.S. Patent Application Publication No. US2004/0007470A1 to Smalley, U.S. Patent Application Publication No. US2004/0020782A1 to Cohen et al., U.S. Patent Application Publication No. US2004/0140862A1 to Brown et al., U.S. Patent Application Publication No. US2003/0127336A1 to Cohen et al., U.S. Patent Application Publication No. US2003/0183008A1 to Bang et al., and U.S. Patent Application Publication No. US2003/0222738A1 to Brown et al.

Because of the existence of MEMS structure on a die and the like, it is often necessary to provide a sealed or otherwise substantially enclosed structure of substantial thickness to enclose a device such as a MEMS device on a die. Forming such a deep hollow enclosed interior with defined channels and apertures sealed by a lid would be difficult to fabricate using a single layer of structural material. Thus, existing technology requires complicated fabrication processes.

Moreover, using standard surface micromachining techniques, sacrificial layers are typically in the range of 1-3 μm using $SiO_2$ or other dielectric materials. Thickness also drops significantly when using evaporated or sputtered metals.

SUMMARY

There is a need for a low cost fabrication process that allows surface micromachined structures, either freely moving or cavity based, to be produced based on electroplated methods and materials.

There also is a need for a fabrication process that can obtain three dimensional structures defining cavities having substantial cavity depth.

A fabrication process is provided that forms three dimensional structures that surround one or more cavities.

According to exemplary embodiments, mechanical and/or structural manifolds and nozzles are formed using electroplating techniques in conjunction with sacrificial materials that can also be formed using electroplated techniques. This can produce devices that are attached at only selected points to a substrate and/or structures having enclosed cavities on or above a working substrate. A particularly relevant use of such structure forming techniques is in the fabrication of a MEMS-based ink jet print head.

In exemplary embodiments, successive layers are patterned using standard lithographic processes and the successive electrodeposition of structural layers, preferably nickel (Ni), and sacrificial layers, such as copper (Cu). Between the deposition of each layer pair, a chemical mechanical polish/planarization step may be performed to smooth out wafer topography before another lithography step is performed. This process can be repeated until a desired structure has been achieved. At this time, the sacrificial layer(s) can be chemically wet etched away, leaving only the electrodeposited structural nickel (Ni) layers.

In exemplary embodiments, sacrificial layers can be deposited with substantial thickness, anywhere from about 1 μm to 150 μm or more. In various embodiments, the thickness is in excess of 100 μm. This greatly broadens the application of electro and electroless deposition of materials for the formation of MEMS-based structures.

In exemplary embodiments, definition and patterning of three dimensional conductive structural layers can be provided using photoresist and electro or electroless deposited materials.

In a particular embodiment, a base substrate is patterned using a photo-patternable polymer, such as a thick photoresist, to define an open region. This open region is electroplated by a metallic layer, such as nickel (Ni) to form a first component of a three dimensional structural element. One example of this is the formation of posts or pillars forming side walls of a three dimensional manifold or nozzle structure. Once electroplating is completed, the photoresist can be removed and the photolithography process repeated. This time a sacrificial layer, such as from copper (Cu), is electroplated over the photoresist and between the posts.

Once electrodeposition has been completed, a second plating process step is performed to deposit a metallic material layer of a suitable thickness on and around the previously deposited sacrificial layer. This latest plating step forms a lid structure that, together with the previously formed pillars, houses and surrounds the sacrificial layer to form a substantially enclosed cavity. The photo-patterned lid structure includes one or more apertures that expose the sacrificial layer to an exterior of the formed structure. The apertures preferably form ink jet nozzle of substantially small size, on the order of 50 μm or less, particularly in the range of 20-35 μm, or even less.

After completion of this plating step, the photoresist may again be removed, leaving the completed structure, such as a manifold, with a nozzle structure and the sacrificial material enclosed within. The sacrificial layer of Cu can then be removed using a suitable etchant, such as Transene APS-100 Cu etchant that acts through the at least one microscopic aperture to access the sacrificial layer. This results in a hollow enclosure structure built up from various layers. Suitable structures include long narrow ink jet channels for channeling ink and at least one aperture in communication with each channel to eject ink from the channel. Between any of the various layer formation steps, a chemical and/or mechanical planarization step can be performed to smooth out or otherwise manipulate the topology of the electrodeposited structure.

In another embodiment, a base substrate is patterned using a photo-patternable polymer, such as a thick photoresist, to define an open region. This open region is plated by a sacrificial material, such as copper (Cu), to a predefined thickness. Once plating is completed, the photoresist can be removed and the photolithography process repeated, this time defining a post or pillar on top of the plated sacrificial layer and also opening a region around the sacrificial layer material. Once complete, a second plating process step is performed to deposit a metallic material layer of a suitable thickness on and around the previously deposited sacrificial layer. This second plating step forms a sidewall and lid structure, with the sacrificial layer being housed inside this region. After completion of the second plating step, the photoresist is again removed, leaving the completed structure, such as a manifold, with a nozzle structure and the sacrificial material enclosed within. The sacrificial layer can then be removed using a suitable etchant, such as Transene APS-100 Cu etchant as in the previous embodiment. This results in a hollow enclosure structure built up from various layers.

BRIEF DESCRIPTION OF THE DRAWINGS

Various exemplary embodiments of three dimensional structural fabrication will be described in detail, with reference to the following figures, wherein:

FIGS. 16-17 show magnified images of a nickel manifold and nozzle structure formed in accordance with aspects of the fabrication process;

FIGS. 23-25 show various magnified images of the resultant nozzle structures, showing in particular formation of nozzles at various nozzle diameters.

DETAILED DESCRIPTION OF EMBODIMENTS

Figure 1:
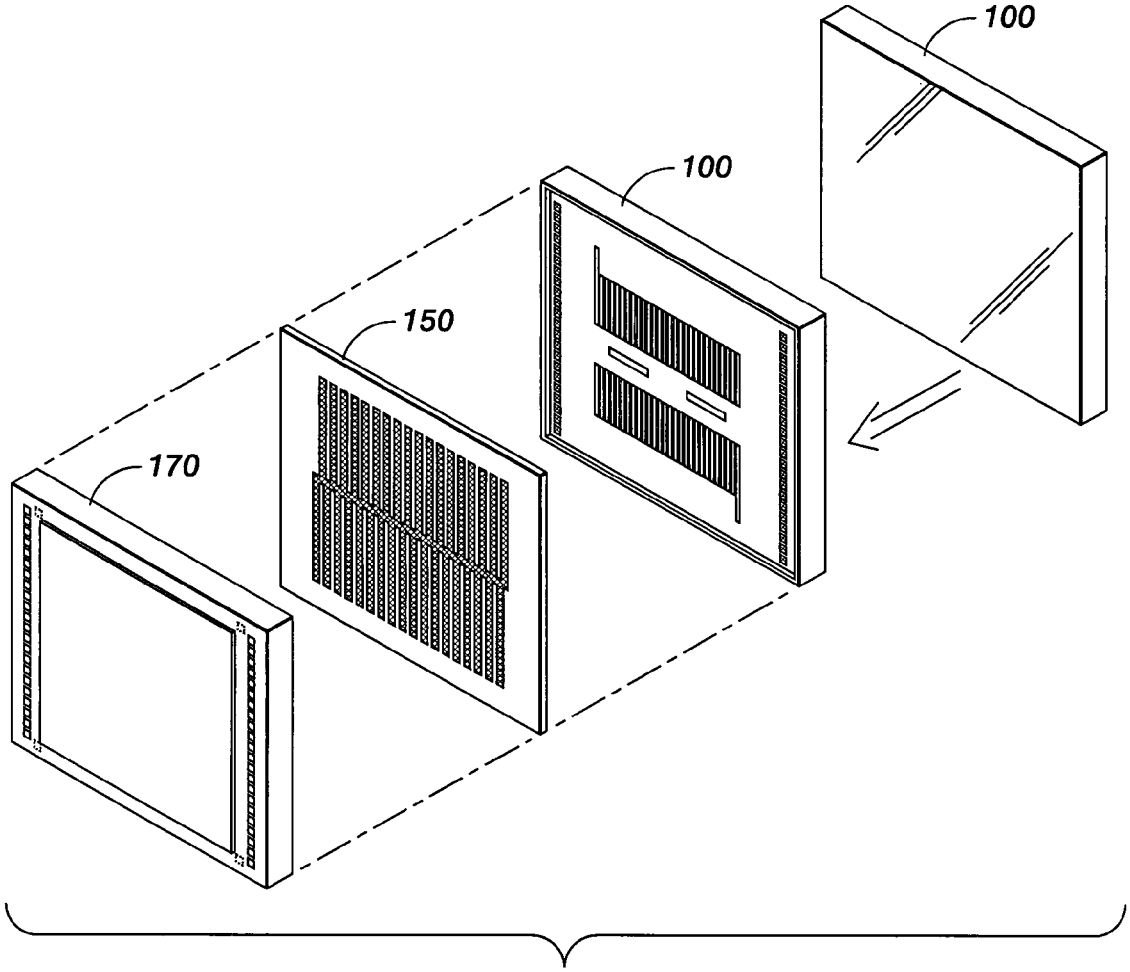
FIG. 1 is an exploded view of an exemplary ink manifold and nozzle assembly integrated with an IC/MEMS fabrication process to form a processed ink jet chip.

Exemplary embodiments provide various processes in which electroplated three-dimensional structures are formed. Preferred three dimensional structures form fluid channels for an ink jet printhead that are integrated with a MEMS-type actuator on the ink jet die and surround the actuator. As shown in FIG. 1, the process uses a first semiconductor die 100, on which may include pre-processed microelectromechanical systems (MEMS) and/or Integrated Circuit (IC) structures using conventional processing techniques as known in the art. One such suitable structure is a mechanical actuator that provides an actuation force to eject a marking fluid, such as ink, through one or more nozzle apertures.

On this MEMS/IC processed die, manifold structures 150, preferably ink channels and inlets, are formed using standard lithographic processes and electrodeposition of three dimensional structural layers. A suitable material for electrodeposition is nickel (Ni). Nozzle structures 170 are also formed on the die 100 using electrodeposition and sacrificial layers. The nozzle structures form a top layer to the structure and include one or more nozzle apertures. This fabrication process forms a complete three dimensional electrodeposited structure that encloses the sacrificial layer which, after selectively etching to remove the sacrificial material for substantially enclosing hollow cavities, may form fluid channels for an ink jet printhead.

Figure 2:
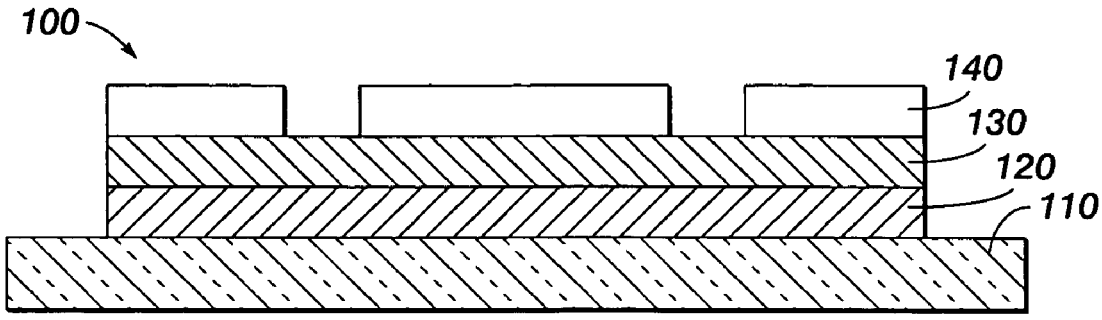
FIGS. 2-7 show a fabrication process according to an embodiment in which a three dimensional structure defining a cavity is formed by multiple electroplating layers and a sacrificial layer.

A more complete explanation of a first embodiment of a fabrication process with be provided with reference to FIGS. 2-7. As shown in FIG. 2, a first semiconductor wafer or die 100 is formed from a base substrate 110 such as silicon or glass. Base substrate 110 may have been previously processed as known in the art to include microelectromechanical systems (MEMS), such as polysilicon ink actuator elements, and/or Integrated Circuit (IC) structures on the surface. Metallized seed layers 120, 130 are formed on base substrate 100 in desired locations in preparation for an electroplating step. Preferred seed layers 120 and/or 130 are formed from a suitable seed material, such as Ti and/or Au.

Open areas are then patterned, using a thick photoresist 140, such as Shipley BPR-100, AZ 9620, or other known or subsequently developed resist films. An exemplary photoresist has a thickness of about 40 μm. Although any size of photoresist could be used, it is desirable to use the thickest available size to fabricate three dimensional structures with higher internal cavity heights. This allows formation of small 3D structures with a minimal amount of steps. Preferably, the walls are formed in a single electroplating step, and a roof formed with a single electroplating step. If the height of a desired three dimensional structure is more than the thickness of available photoresist, the three dimensional structure can be completed using a series of layering steps to form side walls of a desired height and profile. Contemplated hollow cavities to be formed have a thickness in the range of 1 to about 150 μm or more. Preferred embodiments have cavities of at least around 70 μm, more preferably 100 μm or more. Between deposition of each layer, a chemical or mechanical polish or planarization step can be performed to smooth out the layer topography before another lithography step is performed.

Figure 3:
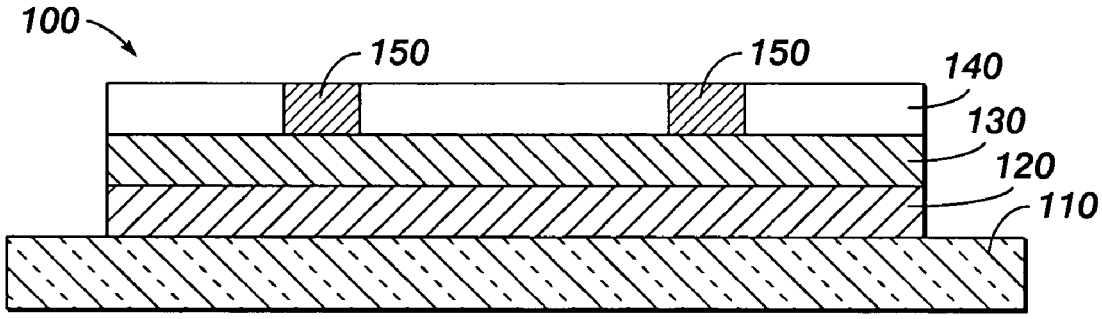

As shown in FIG. 3, a metal layer 150, such as nickel Ni, is then electrodeposited over the photoresist 140 to form a first three dimensional structural component, such as a manifold structure or posts/pillars surrounding already present polysilicon actuator elements (unshown and formed by conventional MEMS processing) used for ejecting ink. Such components form side walls of eventual fluid cavities. This electroplated manifold structure 150 has a thickness on the order of 40-50 μm or possibly more and forms an ink reservoir enclosure for an ink jet print head.

Figure 4:
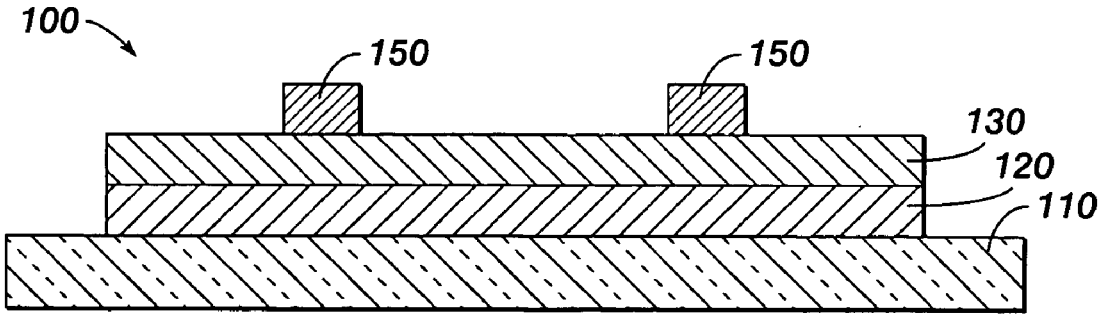
Figure 5:
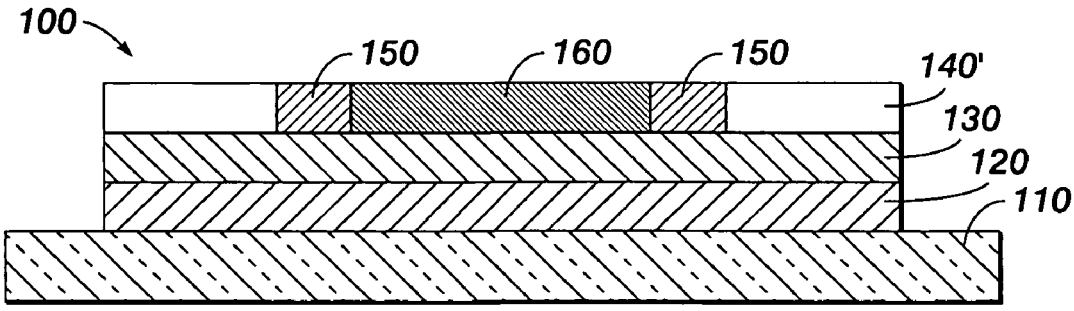

After removal of the photoresist 140, the Ni structural layer forming posts 150 has the structure shown in FIG. 4. In particular, this electroplated structure defines outer walls of the structure as well as inner chambers where a fluid such as ink is delivered before being ejected through a nozzle element. If this post height is insufficient for a particular application, it can be increased by applying another layer of photoresist and electrodeposited material on the previously applied Ni layer to achieve side walls of additional height. However, preferred embodiments use only a single electrodeposition layer for the side of the 3D structure and a single electrodeposition layer for the roof of the 3D structure to reduce processing time and costs and fabrication complexity.

Using another patterned layer of photoresist 140', such as Shipley BPR-100 or AZ 9620, a thin layer of a suitable sacrificial material, such as a metal, for example, copper (Cu), is used to deposit a thick Cu film 160 that covers what will eventually be a cavity structure. In this example, the sacrificial layer is provided between the two Ni posts 150 and blocked by resist 140'. Again, if higher cavity height is necessary, this electrodeposition step can be repeated to form sequential layers of sacrificial layers 160 until a suitable height and profile is attained. As with the Ni layer, between deposition of each sacrificial layer, a chemical or mechanical polish or planarization step can be performed to smooth out the layer topography before another lithography step is performed.

Figure 6:
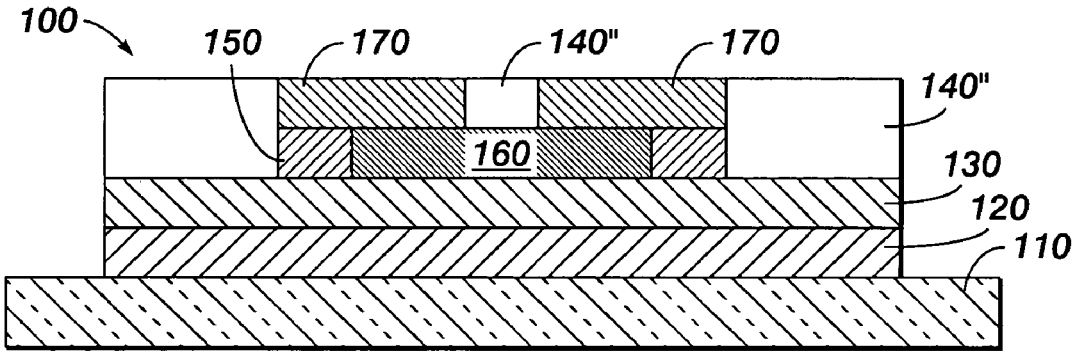

Using another patterned layer of photoresist 140", such as Shipley BPR-100 or AZ 9620, as shown in FIG. 6, a thin layer of a suitable structural material, such as Ni, is again used to deposit a thick Ni film 170 forming a second component of the three dimensional structure. In this example, the second component is a lid structure that, in conjunction with the previously electrodeposited side wall posts 150, at least partially defines a substantially closed cavity or housing that contains the sacrificial layer 160. In a preferred embodiment, this lid structure forms a nozzle plate that includes one or more apertures. The nozzle plates in a preferred embodiment have a thickness of between about 15-20 μm. However, other thicknesses are contemplated. In exemplary embodiments, each nozzle aperture has a diameter in the range of 50 μm or less, more preferably 20-35 μm, or even slightly smaller.

Figure 7:
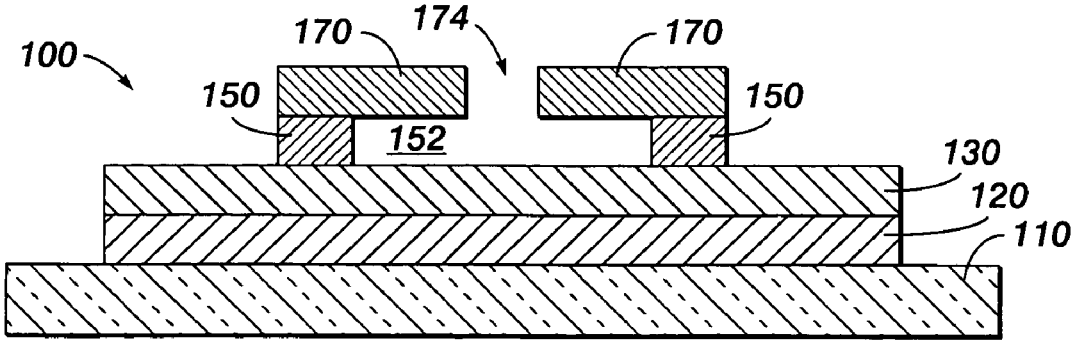

Once this electrodeposition is completed, the photoresist 140" can be removed, preferably by using a combination of Acetone and ultrasonic agitation. Then, the sacrificial electrodeposited sacrificial layer(s) 160, such as Cu, can be chemically removed, such as by a selective wet etching, leaving only the Ni structural layers as shown in FIG. 7. A particularly suitable selective etchant that selectively removes copper (Cu) while having negligible effect on nickel (Ni) is Transene APS-100 Cu etchant.

Accordingly, a three dimensional structure defining at least one cavity or enclosure 252 can be formed through a set of photolithography and electrodeposition steps, followed by removal of at least one sacrificial layer. Moreover, the top structural element 170 may include one or more apertures 172.

Figure 8:
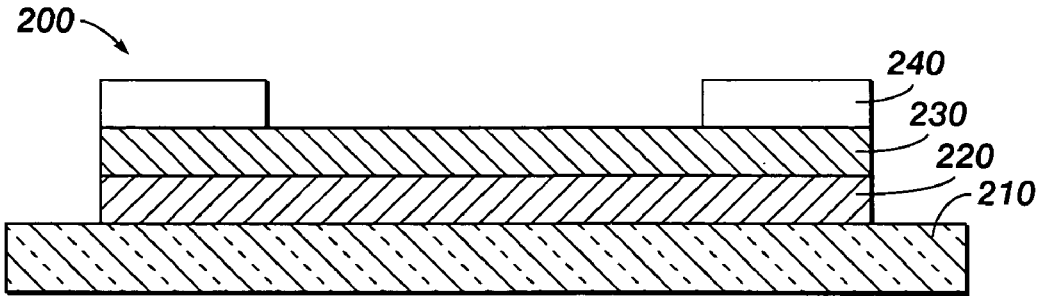
FIGS. 8-11 show a fabrication process according to another embodiment in which a three dimensional structure defining a cavity is formed in a single layer and a sacrificial layer.

An alternative embodiment will be described with reference to FIGS. 8-11. In FIG. 8, a first semiconductor wafer or die 200 is formed from a base substrate 210. Base substrate 210 may have been previously processed as known in the art to include microelectromechanical systems (MEMS), such as polysilicon ink actuator elements, and/or Integrated Circuit (IC) structures on the surface. Metallized seed layers 220, 230 are formed on base substrate 210 in desired locations in preparation for an electroplating step. Preferred seed layers 220 and/or 230 are formed from a suitable seed material, such as Ti and/or Au. Open areas are then patterned, using a thick photoresist 240, such as Shipley BPR-100, AZ 9620, or other known or subsequently developed resist films similar to the previous embodiment. An exemplary photoresist has a thickness of about 40 μm. Although any size of photoresist could be used, it is desirable to use the thickest available size to fabricate three dimensional structures with higher internal cavity heights. If the height of a desired three dimensional structure is more than the thickness of available photoresist, the three dimensional structure can be completed using a series of layering steps to form side walls of a desired height and profile. Between deposition of each layer, a chemical or mechanical polish or planarization step can be performed to smooth out the layer topography before another lithography step is performed.

Figure 9:
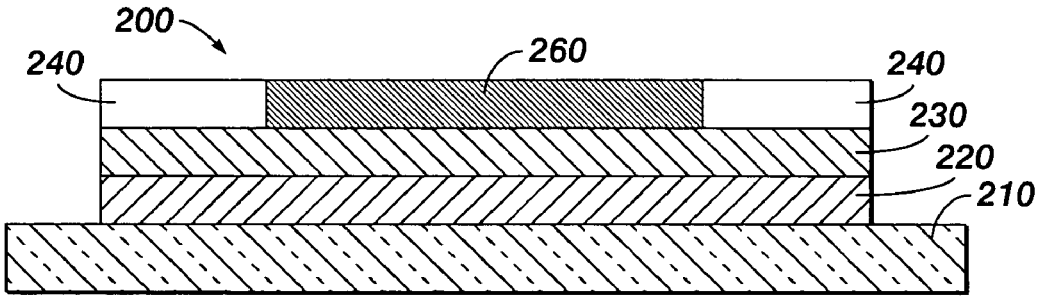
Figure 10:
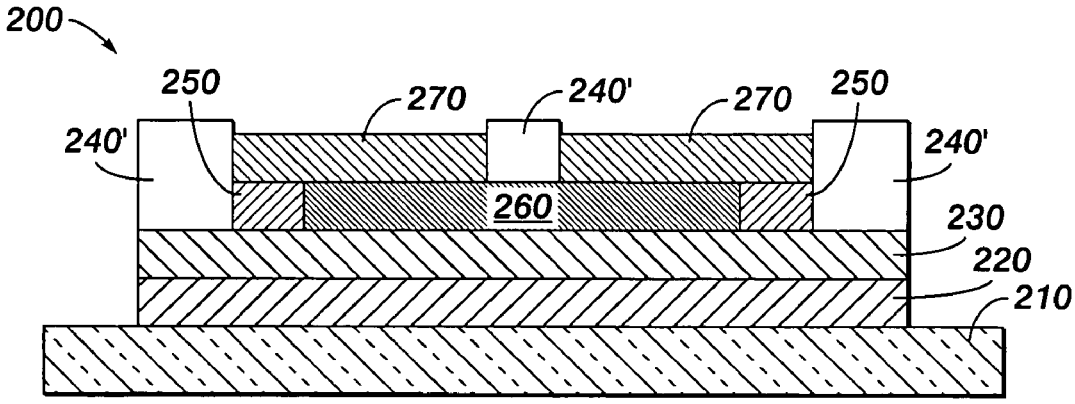

As shown in FIG. 9, this embodiment differs from the prior embodiment by forming the sacrificial layer prior to formation of the structural layers. In particular, a thin layer of a suitable sacrificial material, such as a metal, for example, copper (Cu), is used to deposit a thick Cu film 260 that covers what will eventually be a cavity structure.

Upon removal of photoresist 240, another layer of photoresist 240' may be applied. A metal structural layer 250, such as nickel Ni, is then electrodeposited over the photoresist 240' and sacrificial layer 260 to form a complete three dimensional structural in a single processing step. In particular, due to the provision of photoresist 240' and the previously applied sacrificial layer 260, both side wall posts 250 and a lid structure 270 with one or more apertures 274 can be electrodeposited in a single processing step. This electroplated structure defines outer walls of the structure as well as inner chambers where ink is delivered before being ejected through a nozzle plate element. If this height is insufficient for a particular application, this step can be repeated by applying another layer of photoresist and electrodeposition to build upon the previously applied Ni layer and achieve side walls of additional height. As with the prior embodiment, between deposition of each layer, a chemical or mechanical polish or planarization step can be performed to smooth out the layer topography before another lithography step is performed.

Figure 11:
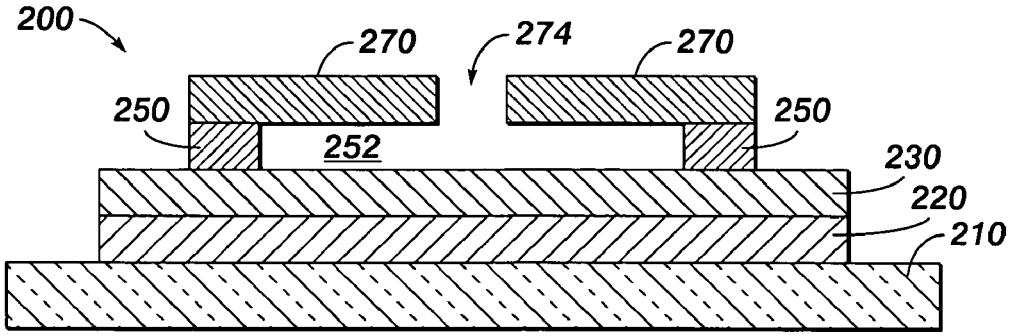

Once this electrodeposition is completed, the photoresist 240' can be removed, preferably by using a combination of Acetone and ultrasonic agitation. Then, the sacrificial electrodeposited sacrificial layer(s) 260, such as Cu, can be chemically removed, preferably using the same selective etchant as in the prior embodiment, leaving only the Ni structural layers as shown in FIG. 11. Accordingly, a three dimensional structure defining at least one cavity 252 and at least one aperture 274 can be formed through a set of photolithography and electrodeposition steps, followed by removal of at least one sacrificial layer using an etchant applied through the aperture(s) of the formed nozzle plate.

Various advantages can be achieved by one or more of the above embodiments. For example, with this fabrication process, it is possible to attain very thick sacrificial layers, anywhere from 1-150 μm or more, and particularly of a height of in excess of 100 μm. This can be realized because the sacrificial layer can be deposited to thicknesses defined by the thickness of the photoresist used. Moreover, even when a photoresist thickness is insufficient, sequential layers of sacrificial material can be provided to build up a total sacrificial thickness of in excess of 100μ or more. This considerably broadens the application of electrodeposition to the formation of MEMS-based structures, particularly ink jet printhead manufacture. Furthermore, this fabrication process can attain high conformality of the sacrificial material to inner sections and exposed regions of an already formed structure. For example, see the cross-sectional views of FIGS. 12-14.

Figure 12:
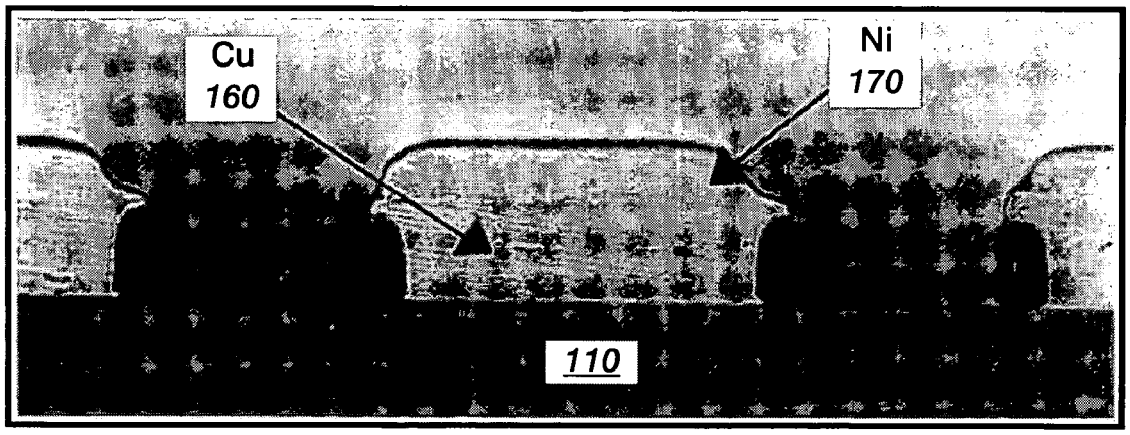
FIG. 12 is a scanning electron microscope (SEM) view of a cross-section of an exemplary three dimensional structure that forms an ink jet manifold.
Figure 13:
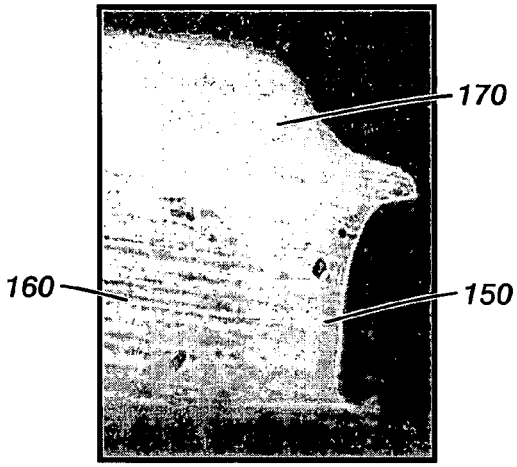
FIG. 13 is a more highly magnified SEM view of a portion of the ink jet manifold cross-section of FIG. 12.
Figure 14:
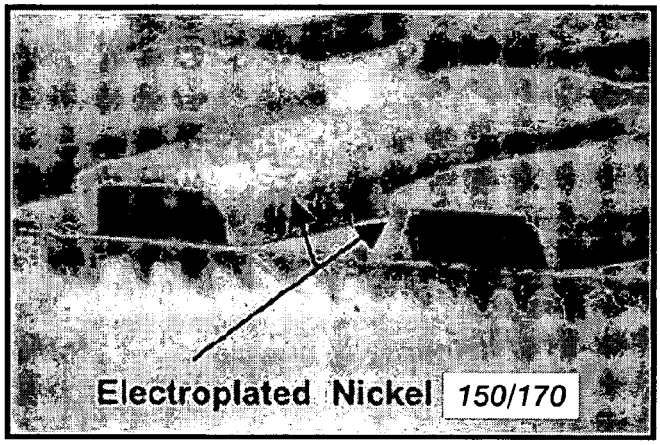
FIG. 14 is a perspective SEM view showing an electroplated nickel manifold and nozzle structure.
Figure 15:
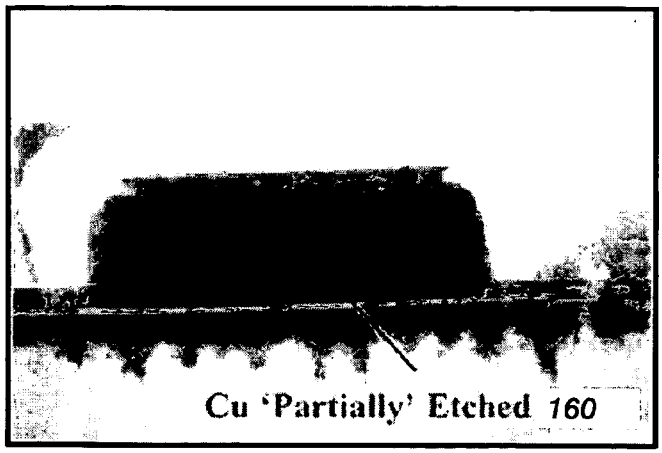
FIG. 15 is a more highly magnified SEM view of a portion of the structure of FIG. 14.
Figure 18:
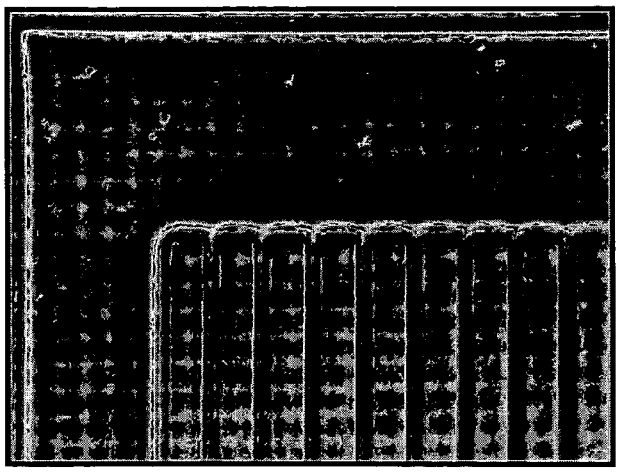
FIGS. 18-22 show various magnified images of the resultant nickel-plated manifold structure.
Figure 19:
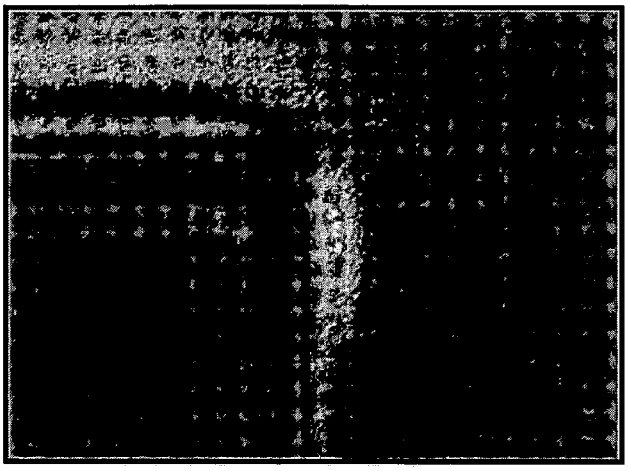
Figure 20:
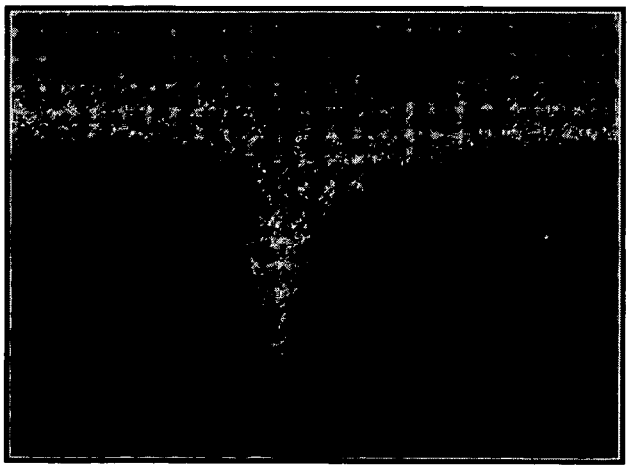
Figure 21:
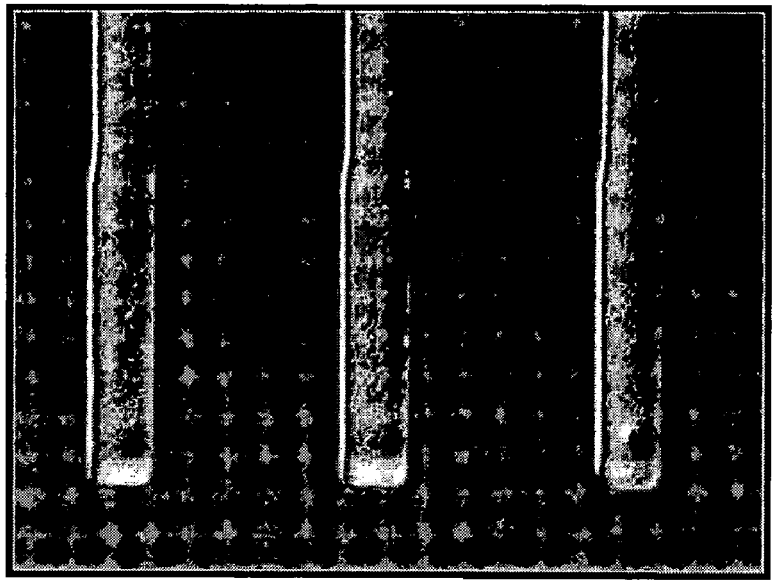
Figure 22:
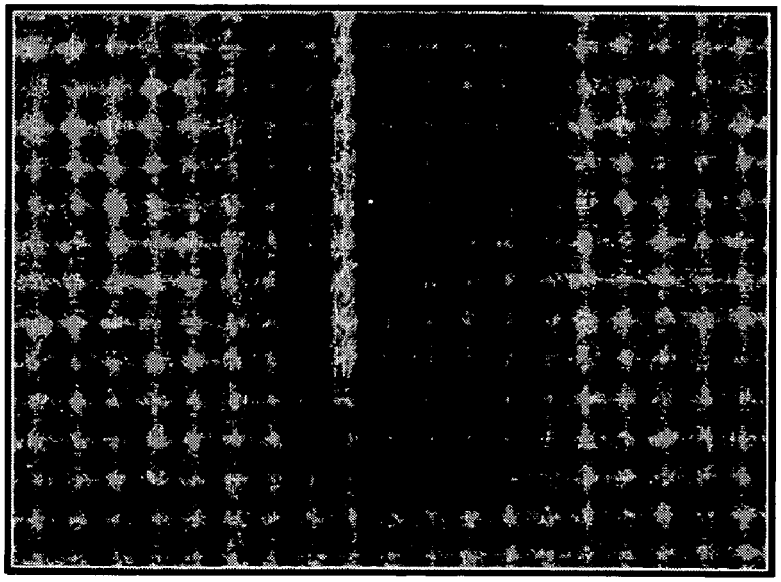

FIG. 12 shows a scanning electron microscope (SEM) view of a cross-section of an exemplary formed three dimensional structure showing the copper sacrificial layer Cu and the overlying structural layer of Ni. This sample is taken, for example, after the steps of FIG. 6 or 10, i.e., before removal of the sacrificial layer. FIGS. 13-14 show SEM views after removal of the sacrificial layer of Cu showing the selectivity of Cu over Ni.

Such fabrication processes also lend themselves to definition and patterning of three dimensional structures or conductive layers and may use an electrodeposited material as a sacrificial layer. Moreover, only one set of seed layer materials may be necessary per stack of structural/sacrificial layer pairs. Further, such fabrication techniques lend themselves to batch processing on a wafer scale level.

Although specific examples use specified materials, it is possible to replace these materials with other electro or electroless depositable material. Moreover, alternative etchants and methods of sacrificial layer removal can be used, depending on the material sets chosen and there respective chemical compatibilities. That is, the etchant chosen must selectively remove the sacrificial layer material while retaining all or a substantial part of the structural material layers.

Additionally, depending on the basic three dimensional structure type and complexity being fabricated, more or fewer steps of lithography and subsequent plating steps may be used.

FIG. 16 shows a scanning electron microscope (SEM) view of the photoresist applied to define the manifold structure. In this example, a thickness of about 40 μm of BPR-100 photoresist is applied. Spray development is performed on a hotplate at about 40° C. FIG. 17 shows an SEM view of an exemplary photoresist layer applied to define the ink nozzle plate structure. The structures shown in FIGS. 16-17 have a total height of about 70 μm.

FIGS. 18-22 show additional SEM views of sample formed Ni plated manifold structures showing various surface details. These shots were taken using a differential interference filter to contrast surface height differences.

Figure 25:
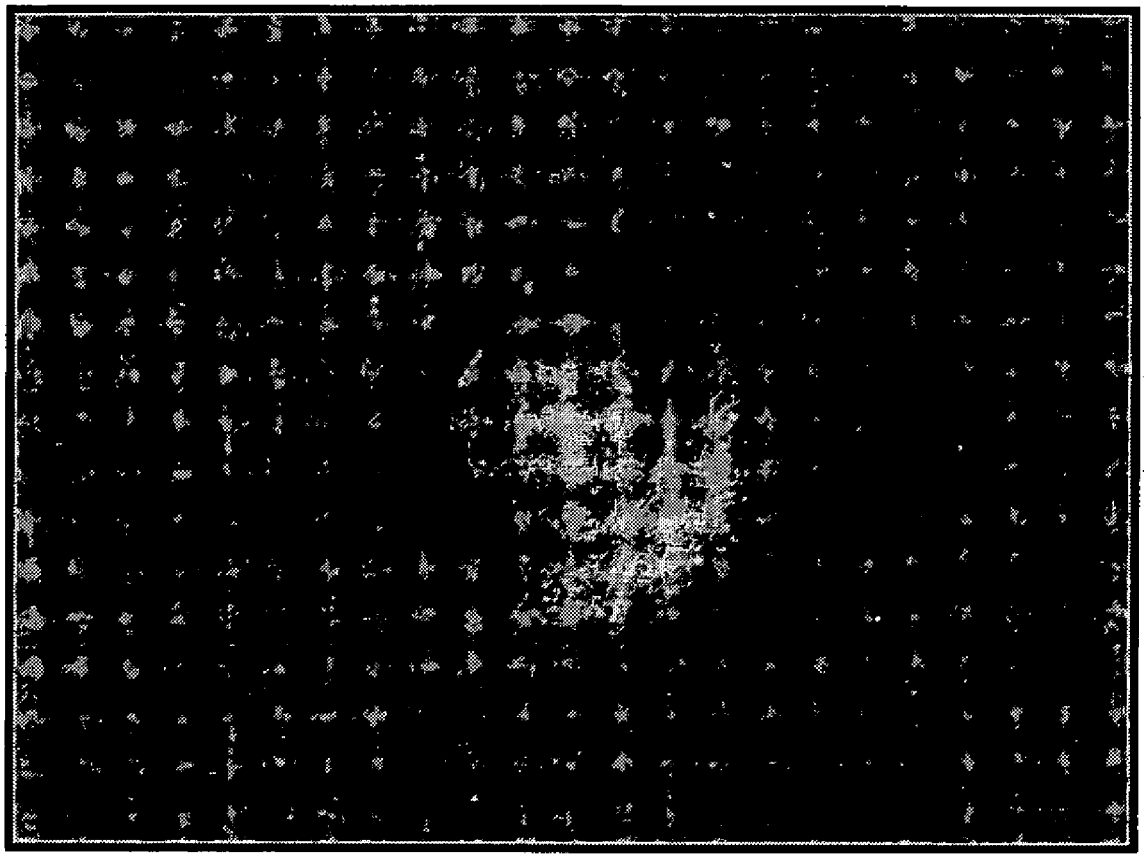

FIGS. 23-25 show details of the electroplated nozzle plate after application of the BPR-100 photoresist and electrodeposition of the Ni. In this sample, various nozzle diameters were experimented with. The thickness of the nozzle plates are around 15-20 μm. In these views, nozzle apertures still contain BPR-100 and are surrounded by electroplated Ni. After removal of the photoresist, the apertures will be opened. As evidenced from the views, the nozzle apertures readily exhibit a tapered edge on the underside of the nozzle plate. This corresponds to the inlet side of the nozzle plate. The outer edge of the aperture (ink outlet side) is typically flat. As also evidenced, nozzles were satisfactorily formed with diameters of as little as 20 μm, while smaller apertures were formed with limited results, but exhibited higher failure rates. This establishes the viability of this fabrication process to accurately produce nozzle apertures of small diameter, on the order of 50 μm or less, and particularly the range of 20-35 μm. This is sufficiently small to enable formation of a high resolution ink jet printhead using 3D manifold and nozzle structures formed from sacrificial layers and electrodeposition techniques.

Accordingly, the exemplary embodiments set forth above are intended to be illustrative, not limiting. Various changes may be made without departing from the spirit and scope of the disclosure. Therefore, the claimed systems and methods, are intended to embrace all known, or later-developed, alternatives, modification, variations, and/or improvements.

What is claimed is:

1. A fabrication process for fabricating three dimensional structures on an ink jet print die, the three dimensional structure covering pre-existing MEMS structure of the print head die and forming at least one substantially enclosed fluid receiving cavity having a height of about 40 μm or more and at least one fluid ejecting aperture, comprising:

applying and patterning a first photoresist mask on an ink jet printhead die having pre-existing MEMS structure thereon;

electrodepositing a sacrificial layer of material into the patterned photoresist mask to define boundaries of a first three dimensional structural element component, the sacrificial layer being formed above the pre-existing MEMS structure;

applying and patterning a second photoresist mask on top of pre-existing layers to define additional boundaries of a three dimensional structural element component;

electrodepositing at least one structural layer of material into the patterned photoresist mask to define side walls of the first three dimensional structural element component adjacent the sacrificial layer and a lid structure substantially covering a top surface of the sacrificial layer, the combination of side walls and lid structure forming a manifold that substantially encompasses and surrounds the sacrificial layer, the lid structure including at least one aperture exposing the sacrificial layer to an exterior of the three dimensional structural element component; and applying a selective etchant through the at least one lid structure aperture to remove the sacrificial material and define a hollow cavity bounded by the three dimensional structural element component that serves as a fluid channel, the fluid channel being in communication with the MEMS structure.

2. The ink jet print die fabrication process according to claim 1, wherein the MEMS structure is an ink actuator.

3. The ink jet print die fabrication process according to claim 1, wherein the structural layer is Ni.

4. The ink jet print die fabrication process according to claim 3, further wherein the sacrificial layer is Cu.

5. The ink jet print die fabrication process according to claim 1, wherein the at least one aperture is a round nozzle.

6. The ink jet print die fabrication process according to claim 5, wherein the round nozzles have a diameter of less than 50 μm.

7. The ink jet print die fabrication process according to claim 6, wherein the round nozzles have a diameter of between about 20 and 35 μm.

8. The ink jet print die fabrication process according to claim 7, wherein the etchant flows to the sacrificial layer solely through the round nozzles.

9. The ink jet print die fabrication process according to claim 6, wherein the etchant flows to the sacrificial layer solely through the round nozzles.

10. The ink jet print die fabrication process according to claim 1, wherein the step of electrodepositing at least one structural layer includes electrodepositing a first structural layer that forms ink manifold side walls prior to electrodeposition of the sacrificial layer, and wherein a second structural layer is electrodeposited over the sacrificial layer and forms the lid and aperture structure.

11. The ink jet print die fabrication process according to claim 1, wherein the step of electrodepositing at least one structural layer includes electrodepositing a structural layer over the sacrificial layer, the structural layer forming both ink manifold side walls and a lid structure.

12. The ink jet print die fabrication process according to claim 1, wherein the sacrificial material has a height of at least 100 μm to form a fluid channel cavity of substantially this height.

13. The ink jet print die fabrication process according to claim 1, wherein the sacrificial material has a height of at least 40 μm to form a fluid channel cavity of substantially this height.

14. The ink jet print die fabrication process according to claim 13, wherein the sacrificial material is formed from a single electrodeposited layer to form a fluid channel cavity of substantially this height.

15. The ink jet print die fabrication process according to claim 13, comprising successively applying at least two sacrificial layers on top of each other to provide the fluid channel height.

16. A fabrication process for fabricating three dimensional structures on an ink jet print die, the three dimensional structure covering pre-existing MEMS structure of the print head die and forming at least one substantially enclosed fluid receiving cavity having a height of about 40 μm or more and at least one fluid ejecting aperture having a diameter of less than 50 μm, comprising:

applying and patterning a first photoresist mask on an ink jet printhead die having pre-existing MEMS structure thereon;

electrodepositing a sacrificial layer of material into the patterned photoresist mask to define boundaries of a first three dimensional structural element component, the sacrificial layer being formed above the pre-existing MEMS structure;

applying and patterning a second photoresist mask on top of pre-existing layers to define additional boundaries of a three dimensional structural element component;

electrodepositing at least one structural layer of material into the patterned photoresist mask to define side walls of the first three dimensional structural element component adjacent the sacrificial layer and a lid structure substantially covering a top surface of the sacrificial layer, the combination of side walls and lid structure forming a manifold that substantially encompasses and surrounds the sacrificial layer, the lid structure including at least one aperture having a diameter of less than 50 μm exposing the sacrificial layer to an exterior of the three dimensional structural element component; and applying a selective etchant through the at least one lid structure aperture to remove the sacrificial material and define a hollow cavity bounded by the three dimensional structural element component that serves as a fluid channel, the fluid channel being in communication with the MEMS structure.

17. The ink jet print die fabrication process according to claim 16, wherein the MEMS structure is an ink actuator.

18. The ink jet print die fabrication process according to claim 16, wherein the at least one aperture forms round nozzles having a diameter of between about 20 and 35 μm.

19. A fabrication process for fabricating three dimensional structures on an ink jet print die, the three dimensional structure covering pre-existing MEMS structure of the print head die and forming at least one substantially enclosed fluid receiving cavity having an internal height of about 40 μm or more and at least one fluid ejecting aperture having a diameter of less than 50 μm, comprising:

applying and patterning a first photoresist mask on an ink jet printhead die having pre-existing MEMS structure thereon;

electrodepositing a sacrificial layer of material into the patterned photoresist mask to define boundaries of a first three dimensional structural element component, the sacrificial layer being formed above the pre-existing MEMS structure;

applying and patterning a second photoresist mask on top of pre-existing layers to define additional boundaries of a three dimensional structural element component;

electrodepositing at least one structural layer of material into the patterned photoresist mask to define side walls of the first three dimensional structural element component adjacent the sacrificial layer and a lid structure substantially covering a top surface of the sacrificial layer, the combination of side walls and lid structure forming a manifold that substantially encompasses and surrounds the sacrificial layer, the lid structure including at least one aperture forming a fluid ejecting nozzle having a diameter of less than 50 μm exposing the sacrificial layer to an exterior of the three dimensional structural element component; and applying a selective etchant through the at least one lid structure aperture to remove the sacrificial material and define a hollow cavity bounded by the three dimensional structural element component that serves as a fluid channel, the fluid channel being in communication with the MEMS structure.

* * * * *

UNITED STATES PATENT AND TRADEMARK OFFICE

CERTIFICATE OF CORRECTION

PATENT NO. : 7,335,463 B2
APPLICATION NO. : 11/012697
DATED : February 26, 2008
INVENTOR(S) : Michel A. Rosa and Eric Peeters It is certified that error appears in the above-identified patent and that said Letters Patent is hereby corrected as shown below:

On the Title page
Please delete the following:

Item (73) Assignee: Palo Alto Research Center, Inc., Palo Alto, CA (US)

On the Title page
And Replace with the Following:

Item (73) Assignee: Palo Alto Research Center Incorporated, Palo Alto, CA (US)

Signed and Sealed this

Seventh Day of October, 2008

JON W. DUDAS
*Director of the United States Patent and Trademark Office*